US008881399B2

(12) United States Patent
Yanata et al.

(10) Patent No.: US 8,881,399 B2
(45) Date of Patent: Nov. 11, 2014

(54) METHOD OF MANUFACTURING A NOZZLE PLATE FOR A LIQUID EJECTION HEAD

(75) Inventors: Atsuro Yanata, Hachioji (JP); Isao Doi, Toyonaka (JP)

(73) Assignee: Konica Minolta Holdings, Inc., Tokyo (JP)

( * ) Notice: Subject to any disclaimer, the term of this patent is extended or adjusted under 35 U.S.C. 154(b) by 908 days.

(21) Appl. No.: 12/310,380

(22) PCT Filed: Aug. 17, 2007

(86) PCT No.: PCT/JP2007/066022

§ 371 (c)(1),
(2), (4) Date: Feb. 23, 2009

(87) PCT Pub. No.: WO2008/026455

PCT Pub. Date: Mar. 6, 2008

(65) Prior Publication Data

US 2009/0195605 A1 Aug. 6, 2009

(30) Foreign Application Priority Data

Aug. 31, 2006 (JP) ..... 2006-236050
Sep. 20, 2006 (JP) ..... 2006-254126

(51) Int. Cl.
*B41J 2/16* (2006.01)
*B41J 2/14* (2006.01)

(52) U.S. Cl.
CPC ..... *B41J 2/162* (2013.01); *B41J 2/1642* (2013.01); *B41J 2/1623* (2013.01); *B41J 2/1433* (2013.01); *B41J 2/161* (2013.01); *B41J 2/1631* (2013.01); *B41J 2/1632* (2013.01); *B41J 2/1628* (2013.01); *B41J 2/1646* (2013.01); *B41J 2/1645* (2013.01); *B41J 2202/11* (2013.01)
USPC ..... 29/890.1; 216/27; 216/41; 216/42; 347/44; 347/45; 347/47

(58) Field of Classification Search
USPC ..... 29/890.1; 216/58, 67, 41, 42, 44, 24, 216/39, 27; 438/689, 734, 735; 347/44, 45, 347/47
See application file for complete search history.

(56) References Cited

U.S. PATENT DOCUMENTS 4,383,026 A * 5/1983 Hall ..... 217/67 X
5,549,212 A * 8/1996 Kanoh et al. ..... 216/39

(Continued)

FOREIGN PATENT DOCUMENTS

CN 1684834 A 10/2005
JP 60198823 A * 10/1985

(Continued)

OTHER PUBLICATIONS

Machine Language Translation of JP 9-216368.*

(Continued)

*Primary Examiner* — A. Dexter Tugbang
(74) *Attorney, Agent, or Firm* — Holtz, Holtz, Goodman & Chick PC

(57) ABSTRACT

A manufacturing method of nozzle plate for liquid ejection head includes, providing a substrate having a first base material of Si and a second base material, of which the etching rate in Si anisotropic dry etching is lower then that of Si, provided on one side of the first base material, forming a film as a second etching mask on the surface of the second base material, forming a second etching mask pattern having a small-diameter opening shape in the second etching mask film, etching until the etching part is extended through the second base material, forming a film as a first etching mask film on the surface of the first base material, forming a first etching mask pattern having a large-diameter opening shape in the first etching mask film, and Si anisotropic dry etching until the etched part is extended through the first base material.

7 Claims, 9 Drawing Sheets

(56) References Cited

U.S. PATENT DOCUMENTS

| | | | | |
|---|---|---|---|---|
| 5,972,794 | A * | 10/1999 | Katakura | 438/734 X |
| 6,345,881 | B1 * | 2/2002 | Yang et al. | 347/47 X |
| 7,022,607 | B2 * | 4/2006 | Yoshizawa | 438/689 |
| 7,449,283 | B2 | 11/2008 | Nishi et al. | |
| 2006/0176338 | A1 | 8/2006 | Deguchi et al. | |

FOREIGN PATENT DOCUMENTS

| | | | | |
|---|---|---|---|---|
| JP | 05-229130 | A | 9/1993 | |
| JP | 06031914 | A * | 2/1994 | 29/890.1 X |
| JP | 06-134994 | A | 5/1994 | |
| JP | 9-216368 | A | 8/1997 | |
| JP | 11-028820 | A | 2/1999 | |
| JP | 2002-059552 | A | 2/2002 | |
| JP | 2003-341070 | A | 12/2003 | |
| JP | 2004-106199 | A | 4/2004 | |
| JP | 2006-218673 | A | 8/2006 | |
| JP | 2006218673 | A | 8/2006 | |
| WO | WO 2006/067966 | A1 | 6/2006 | |

OTHER PUBLICATIONS

Machine Language Translation of JP 9-216368, Feb. 2011.*

* cited by examiner

METHOD OF MANUFACTURING A NOZZLE PLATE FOR A LIQUID EJECTION HEAD

This application is the United States national phase application of International Application PCT/JP2007/066022 filed Aug. 17, 2007.

TECHNICAL FIELD

The present invention relates to a manufacturing method of a nozzle plate for a liquid ejection head, a nozzle plate for a liquid ejection head, and a liquid ejection head.

BACKGROUND ART

In recent years, high speed and high resolution printing is demanded for ink-jet system printers. Semiconductor processes for silicon substrates, which are microfabrication technologies in the micromachine fields, are applied to the forming method of ink-jet system recording heads employed in the above printers. Consequently, many methods have been proposed which form fine-structured bodies via applying etching onto silicon substrates. Of these, known is a method to form nozzles of an ink-jet system head in such a manner that a silicon substrate is subjected to the following types of etching.

(1) A resist film is formed on the surface of a single crystalline silicon substrate and a first open pattern is formed by removing the portion of the resist film corresponding to the back-end side of the nozzle, while a second open pattern is formed which is smaller than the first open pattern by removing the portion of the resist film corresponding to the tip side of the nozzle, and anisotropic dry etching is applied to the exposed portion of the silicon single crystal substrate surface exposed by the first and second open patterns, whereby nozzles are formed which result in a decrease of the cross section from the back-end side to the tip side (refer to Patent Document 1).

(2) A small cross-sectional nozzle is formed from one side of the silicon substrate via dry etching and a part of a large cross-sectional nozzle and a part of a cross-section of an ink chamber provided with an ink chamber communicated with the large cross-sectional nozzle, a pressurizing chamber, and an ink feeding channel are subjected to dry etching from the other side of the silicon substrate to communicate with the small cross-sectional nozzle, whereby a nozzle is formed (refer to Patent Document 2).

(3) A buffer layer, which exhibits a lower etching rate compared to a single crystal silicon wafer, is sandwiched between two single crystal silicon wafers to result in integration via close adhesion and both sides of the integrated two single crystal silicon wafers are subjected to etching so that the bottom portion forms holes, each of which reaches the buffer layer. Thereafter, etching is applied to the side on which the bottom diameter of the hole of the buffer layer is smaller, whereby a nozzle hole is formed (refer to Patent Document 3).

Further, characteristics of the surface of the nozzle plate, where the nozzles are formed, affect ejection characteristics of ink droplets. For example, when ink adheres to the periphery of the ejection hole of the nozzle plate to generate non-uniform ink puddles, problems occur in which, for example, when non-uniform ink puddles are generated via adhesion of the ink at the periphery of the ejection hole of the nozzle plate, the ejection direction of ink droplets is bent, the ink droplet size fluctuates, and the flying rate of ink droplets become unstable.

Consequently, as described in Patent Document 4, a technology is known in which forms a liquid repellent treatment on the side of the nozzle plate liquid ejection direction.

According to Patent Document 4, fluorosilane, having at least one hydrolyzable group and silicon atoms bonded to an organic group having at least one fluorine, is applied onto the ejection surface of a liquid ejection head, followed by thermal treatment. Thereafter, a surface treatment is carried out to remove any residual fluorosilane. By carrying out the above surface treatment, a liquid repellent film is formed on the edge surface of the liquid ejection head, whereby it becomes possible to minimize the above drawbacks due to adhesion of ink droplets near the ejection hole.

Further, when nozzle forming members which form a nozzle hole are resinous materials, in order to enhance adhesion of the above liquid repellent film, a technology is known in which an $SiO_2$ film is formed between the nozzle forming member and the liquid repellent film (refer, for example, to Patent Document 5). A nozzle plate which is formed by employing an $SiO_2$ film as an intermediate layer, as described above, results in higher adhesion of the liquid repellent film and exhibits higher resistance to rubbing such as wiping.

Patent Document 1: Japanese Patent Publication Open to Public Inspection (hereinafter referred to as JP-A) No. 11-28820

Patent Document 2: JP-A No. 2004-106199

Patent Document 3: JP-A No. 6-134994

Patent Document 4: JP-A No. 5-229130

Patent-Document 5: JP-A No. 2003-341070

DISCLOSURES OF THE INVENTION

Problems to be Solved by the Invention

In a nozzle plate employed in the ink-jet system recording head, which enables high resolution printing, it is not only necessary that diameters of a plurality of ejection holes, from which ink is ejected, is equal to each other at high accuracy, but it is also necessary that the length of the hole leading to the aperture of the ejection hole is realized at high accuracy. The above length of the hole relates to channel resistance. Even though hole diameters are identical, in the case in which the hole length differs, ejection states such as an ejection amount or a flying state differ, whereby the state of ink deposited on the surface to be printed fluctuate. Consequently, a problem occurs in which it is not possible to achieve the desired high quality printing.

In any of the nozzle forming methods described in Patent Documents 1 and 2, a small cross-sectional nozzle hole to eject ink is formed via dry etching. However, no description is made with regard to high accuracy realization of the length of the small cross-sectional nozzle hole (hereinafter referred to as the nozzle length) which refers to the above hole length.

Realization of a uniform nozzle length includes the following case. Etching conditions are determined via previous experiments for each of the employed etching devices, and under predetermined conditions, the nozzle length is controlled by controlling the etching amount via the etching period. However, in the above case, even though the same etching device is employed and the same etching conditions are set, in the practical etching, accuracy enhancement of the nozzle length via controlling the period is naturally limited, whereby at present, nozzle length fluctuates. In order to enhance accuracy of the nozzle length, complicated processes are required in which etching is temporarily terminated, the resulting nozzle length is measured in the outside of the etching device, and etching is repeated based on the measured result. When high quality printing of high resolution is required, it has further been demanded to minimize degradation of printing quality due to fluctuation of the above nozzle length.

Further, in the method described in Patent Document 3, employed is a substrate in which the buffer layer which exhibits a lower etching rate compared to that of the single-crystal silicon wafer is sandwiched between two single-crystal silicon wafers. In this case, due to the presence of the buffer layer which exhibits a lower etching rate, when etching is carried out to reach the above buffer layer, the etching is terminated. Accordingly, it becomes easier to control the etching amount depending on the degree of the etching rate, and the thickness of the single-crystal silicon wafer approximately becomes the nozzle length without any modification, whereby it is possible to realize the nozzle length under high accuracy. However, it is not easy to produce a substrate in which the buffer layer is sandwiched between two silicon wafers. Further, such a substrate is commercially available as SOI (Silicon On Insulator), but it is very expensive. Still further, since in addition to the hole formation on both surfaces, a process which removes the buffer layer in the bottom of the hole is necessary, this production process is complex.

Additionally, in liquid ejection apparatuses over recent years, problems have occurred in which it was necessary to accurately form a small ejection hole of the nozzle to eject more minute liquid droplets. Specifically, in a liquid ejection apparatus which is provided with a meniscus forming means, such as a piezoelectric element, which forms a meniscus of liquid droplets at the ejection hole, and an electrostatic voltage generating means which generates electrostatic attraction between the ejection hole and the object to be deposited by liquid droplets, problems have occurred in which fluctuation of the nozzle diameter and the nozzle length adversely affect the ejection capability of the nozzle. In addition, in such a liquid ejection apparatus, problems have occurred in which ejection capability of each nozzle fluctuates, whereby a complicated control such as adjustment of drive voltage and a wave form is required for each nozzle.

In view of the foregoing, the present invention was achieved. An object of the present invention is to provide a less expensive nozzle plate for a liquid ejection head which is capable of appropriately ejecting liquid from each ejection hole without fluctuation, a manufacturing method thereof, and a liquid ejection head provided with the same.

Means for Solving the Problem

The above problems have been solved via the following embodiments.

1. In a manufacturing method of a nozzle plate for a liquid ejection head, which is composed of a substrate having a through-hole, which is composed of a large diameter portion open into one side surface of the aforesaid substrate and a small diameter portion open into the other side surface, which has a smaller cross-section than that of the aforesaid large diameter portion, and in which the aperture of the aforesaid small diameter portion of the aforesaid through-hole is employed as a liquid droplet ejection hole, a manufacturing method of a nozzle plate for a liquid ejection head, wherein a process which prepares a substrate which is composed in such a manner that on one side of a first base material composed of Si, a second base material is arranged which exhibits a lower etching rate than Si during Si anisotropic dry etching, a process which forms, on the surface of the aforesaid second base material, a film which is converted to a second etching mask, a process which forms a second etching mask pattern having the aperture shape of the aforesaid small diameter portion by applying a photolithographic treatment and etching to the aforesaid film which is converted to the second etching mask, a process which carries out etching until the aforesaid second base material is passed through, a process which forms, on the surface of the aforesaid first base material, a film which is converted to a first etching mask, a process which forms a first etching mask pattern having an aperture shape of the aforesaid large diameter portion by applying a photolithographic process and etching to the aforesaid film which is converted to the first etching mask, and a process which carries out Si anisotropic dry etching until the aforesaid first base material is passed through, are carried out in the above order.

2. In a manufacturing method of a nozzle plate for a liquid ejection head, which is composed of a substrate having a through-hole, which is composed of a large diameter portion open into the one side surface of the aforesaid substrate and a small diameter portion open into the other side surface, which has a smaller cross-section than that of the aforesaid large diameter portion, and in which the aperture of the aforesaid small diameter portion of the aforesaid through-hole is employed as a liquid droplet ejection hole, a manufacturing method of a nozzle plate for a liquid ejection head, wherein a process which prepares a substrate which is composed in such a manner that on one side of a first base material composed of Si, a second base material is arranged which exhibits a lower etching rate than Si during Si anisotropic dry etching, a process which forms, on the surface of the aforesaid first base material, a film which is converted to a first etching mask, a process which forms a first etching mask pattern having the aperture shape of the aforesaid large diameter portion by applying a photolithographic treatment and etching to the aforesaid film which is converted to the first etching mask, a process which carries out Si anisotropic dry etching until the aforesaid first base material is passed through, a process which forms, on the surface of the aforesaid second base material, a film which is converted to a second etching mask, a process to forms an etching mask pastern having the aperture shape of the aforesaid small diameter portion by applying a photolithographic treatment and etching to the film which is converted to a second etching mask, and a process which carries etching until the aforesaid second base material is passed through, are carried out in the above order.

3. The manufacturing method of a nozzle plate for a liquid ejection head, described in item 1 or 2, wherein the aforesaid second base material is $SiO_2$.

4. The manufacturing method of a nozzle plate for a liquid ejection head, described in any one of items 1 through 3, wherein a process is incorporated to arrange a liquid repellent layer on the surface on the side where the aforesaid liquid droplet ejection hole of the aforesaid substrate is formed.

5. A nozzle plate for a liquid ejection head, which is composed of a substrate having a through-hole, which is composed of a large diameter portion open into one side surface of the aforesaid substrate and a small diameter portion open into the other side surface of the aforesaid substrate, in which the aperture of the aforesaid small diameter portion of the aforesaid though-hole is employed as a liquid droplet ejection hole, wherein a substrate component which constitutes the aforesaid large diameter portion is Si, and a substrate component which constitutes the aforesaid small diameter portion is composed of a component which exhibits a lower etching rate during Si anisotropic dry etching than that of the substrate component which constitutes the aforesaid large diameter portion.

6. The nozzle plate for a liquid ejection head, described in item 5, wherein a substrate component which constitutes the aforesaid small diameter portion is $SiO_2$.

7. The nozzle plate for a liquid ejection head, described in item 5 or 6, wherein a liquid repellent layer is arranged on the surface of the side where the aforesaid liquid droplet ejection hole of the aforesaid substrate is formed.

8. The nozzle plate for a liquid ejection head, described in item 7, wherein the thickness of the aforesaid liquid repellent layer is less than 100 nm and the internal diameter of the aforesaid small diameter portion is less than 10 μm.

9. The nozzle plate for a liquid ejection head, described in item 8, wherein the aforesaid liquid repellent layer is a fluoroalkylsilane based monomolecular layer.

10. The nozzle plate for a liquid ejection head, described in item 8 or 9, wherein the internal diameter of the aforesaid small diameter portion is less than 6 μm.

11. The nozzle plate for a liquid ejection head, described in item 8 or 9, wherein the internal diameter of the aforesaid small diameter portion is less than 4 μm.

12. In a liquid ejection head which is provided with a body plate in which a concave portion is formed and a nozzle plate having a nozzle, the nozzle plate overlaying the aforesaid body plate in such a manner that the aforesaid concave portion is formed as a pressurizing chamber and is provided with a nozzle which communicates with the aforesaid pressurizing chamber by transmitting the displacement of a pressure generator to liquid in the aforesaid pressurizing chamber and ejects droplets of the aforesaid liquid from an ejection hole, a liquid ejection head wherein the aforesaid nozzle plate is the nozzle plate for the liquid ejection head, described in any one of items 5 through 11.

13. The liquid ejection head, described in item 12, wherein, in addition to action of the aforesaid pressure generating means, the aforesaid liquid is ejected in the form of liquid droplets via action of electrostatic force between the electrode, facing the aforesaid nozzle plate, and the nozzle.

Effect of the Invention

According to the invention described in embodiments 1, 2, and 5, the present nozzle plate achieves the following effects. The etching rate during Si anisotropic dry etching of the small diameter portion of a base material is lower than that of the large diameter portion. When the large diameter portion is formed via Si anisotropic dry etching, the etching rate is lowered while Si anisotropic dry etching reaches the base material of the small diameter portion. Consequently, even though etching is excessively carried out while considering fluctuation of the large diameter portion due to Si anisotropic dry etching, it is retarded that the base material of the small diameter portion becomes thinner, whereby it is possible to make the length of the small diameter portion the thickness of the base material. Consequently, it is possible to realize the length of the small diameter portion of the targeted accuracy without fluctuation.

According to the invention described in embodiment 8, even in a nozzle plate having a small ejection hole of an internal diameter of the small diameter portion of less than 10 μm, by forming the thin liquid repellent film of a thickness of less than 100 nm, it is possible to minimize the fluctuation of the nozzle diameter due to intrusion of the liquid repellent film into the ejection hole. In addition, by decreasing the fluctuation of the nozzle length, due to any fluctuation of thickness of the liquid repellent film, it is possible to avoid the resulting effects being applied to the ejection of liquid droplets. Namely, it is possible to minimize fluctuation of ejection capability among nozzles. As described above, since it is possible to minimize fluctuation of the nozzle length, it becomes possible to maintain constant electric field intensity of the tip portion of the meniscus formed on the ejection hole of the nozzle. Further, by decreasing the thickness of the liquid repellent film, it is possible to restrain an increase in the practical nozzle length and the fluid channel resistance, whereby it is possible to restrain an increase in the pressure necessary to eject liquid droplets and drive voltage of a pressure generating means.

According to the invention described in embodiment 9, by forming the fluorosilane based liquid repellent film on the $SiO_2$ film, it is possible to modify the resulting film into a desired monomolecular film. Further, by employing the fluorosilane based liquid repellent film, it is possible to modify the resulting nozzle plate to one which exhibits no change of liquid repellency over a period.

According to the invention described in embodiment 10, by forming the thin liquid repellent film, even though intrusion into the nozzle during formation of the liquid repellent film may occur, adverse effects to ejection capability are lowered, whereby application specifically to a minute nozzle of less than 6 μm becomes possible.

According to the invention described in embodiment 11, by forming the thin liquid repellent film, even though intrusion into the nozzle during formation of the liquid repellent film may occur, adverse effects to ejection capability are lowered, whereby application specifically to a minute nozzle of less than 4 μm becomes possible.

Further, according to the invention described in embodiment 12, by employing the nozzle plate for the liquid ejection head provided with the nozzle plate exhibiting the above effects, it is possible to constitute a liquid ejection head.

Still further, according to the invention described in embodiment 13, by employing the nozzle plate exhibiting the above-mentioned effects in the liquid ejection head which ejects liquid droplets utilizing electrostatic force, it is possible to avoid weeping of ejected liquid from the ejection hole of the nozzle and adhesion of ejected liquid droplets onto the ejection surface of the nozzle plate, whereby it is possible to enhance ejection performance without disturbing the electric field intensity at the tip portion of the meniscus.

Yet still further, since highly insulating $SiO_2$ is employed as a material on the ejection surface side of the nozzle plate, it is possible to carry out ejection via the so-called electric field concentration system in which liquid droplets are ejected via electric field concentration to the meniscus raised at the ejection hole of the nozzle. However, it is possible to carry out ejection via the so-called electrostatic assist system, which does not depend on the high concentration electric field intensity. Further, by regulating the internal diameter of the small diameter portion to less than 6 μm or 4 μm, it becomes possible to set the thickness of the highly insulating $SiO_2$ film, which is necessary for electric field concentration ejection, to be thinner.

Accordingly, it is possible to provide a less expensive nozzle plate for a liquid ejection head capable of preferably ejecting liquid from the ejection hole with no fluctuation, as well as the manufacturing method of the same and as well as a liquid ejection head provided with the same.

PREFERABLE EMBODIMENTS OF THE INVENTION

The present invention will now be described based on represented embodiments thereof, however the present invention is not limited thereto.

Figure 1:
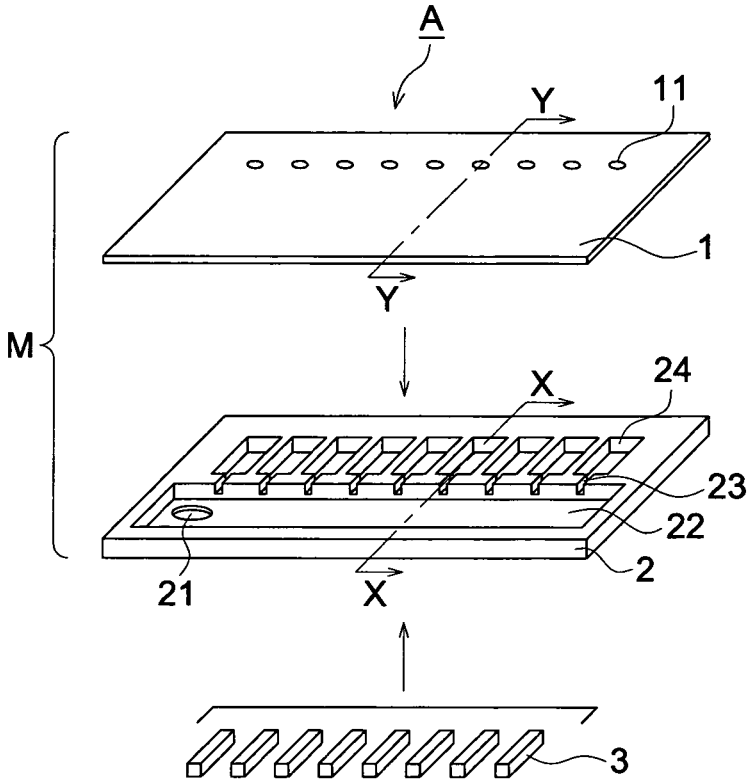
FIG. 1 is a view showing an example of an ink-jet system recording head.

FIG. 1 schematically shows nozzle plate 1, body plate 2, and piezoelectric elements 3 which constitute an ink-jet system recording head (hereinafter referred to as recording head) A, which is an example of a liquid ejection head.

In nozzle plate 1, arranged is a plurality of nozzles 11 to eject ink. Further, in body plate 2, via adhesion of nozzle plate 1, formed are pressurizing chamber grooves 24 each converted to a pressurizing chamber, ink feeding channel grooves 23 each converted to an ink feeding channel, common ink chamber groove 22 converted to a common ink chamber, and ink feeding opening 21.

Further, channel unit M is formed via adhesion of nozzle plate 1 and body plate 2 so that nozzles 11 of nozzle plate 1 and pressurizing chamber grooves 24 of body plate 2 correspond one to one. Hereinafter, each symbol of the pressurizing chamber groove, the feeding channel groove and the common ink chamber groove, which are employed in the above description, is also employed for each of the pressurizing chamber, the feeding channel and the common ink chamber.

Figure 2:
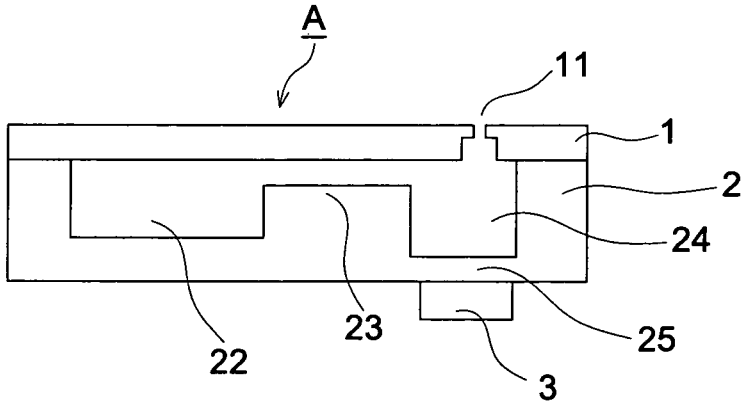
FIG. 2 is a cross-sectional view of an ink-jet system recording head.

FIG. 2 schematically shows the cross-section at Y-Y position of nozzle plate 1 and X-X position of body plate 2, after nozzle plate 1, body plate 2, and piezoelectric element 3 are assembled in above recording head A. As shown in FIG. 2, recording head A is completed via adhesion of piezoelectric element 3, as an actuator for ink ejection, onto the surface of bottom portion 25 of each pressurizing chamber 24, which is opposite the surface of body plate 2 adhered by nozzle plate 1. Drive pulse voltage is applied to each piezoelectric element 3 of above recording head A and vibration generated by piezoelectric element 3 is transmitted to bottom portion 25 of pressurizing chamber 24, whereby pressure in pressurizing chamber 24 results in fluctuation via vibration of above bottom portion 25 so that ink droplets are ejected from nozzles 11.

Figure 3:
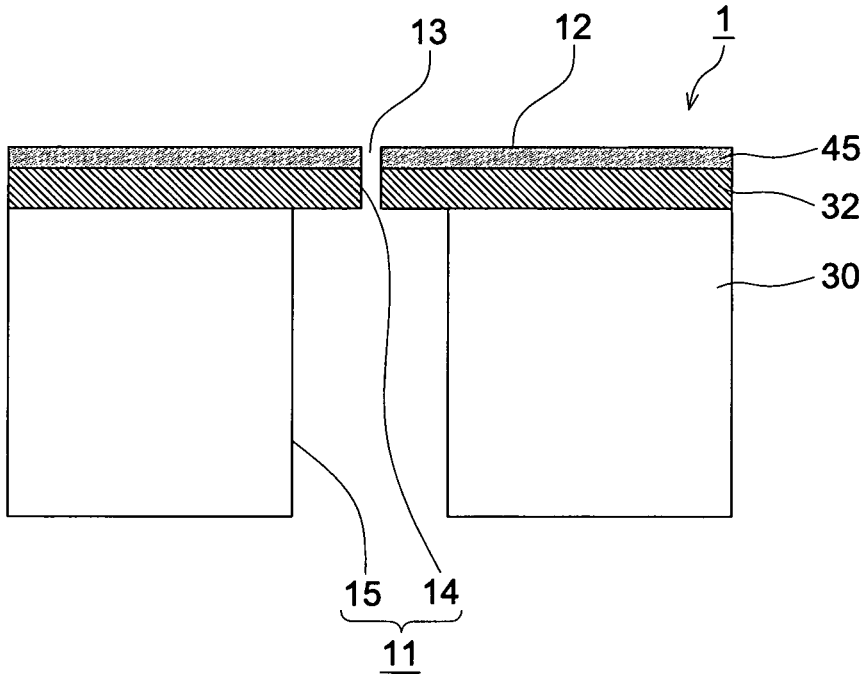
FIG. 3 is a view showing the ejection hole periphery of a nozzle plate.

FIG. 3 shows the cross-section of one of nozzles 11. Nozzle 11 is formed by drilling into nozzle plate 1. Each nozzle 11 is of a two-step structure composed of small diameter portion 14 having ejection hole 13 at ejection surface 12 and large diameter portion 15, located backward, having a larger diameter than small diameter portion 14, of each nozzle plate 1. The length of small diameter portion 14 corresponds to the nozzle length in nozzle plate 1. It is necessary to accurately make the above nozzle length in the same manner as that the diameter of ejection hole 13 which is an aperture of small diameter portion 14 is realized. Incidentally, 30 represents an Si substrate which is a first base material, 32 represents a second base material in which small diameter portion 14 is formed, and 45 represents a liquid repellent layer. These will be further described below.

Figure 4:
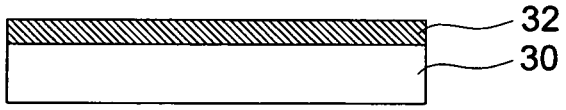
FIGS. 4(*a*) to 4(*f*) are views showing processes to form the small diameter portion.
Figure 4:
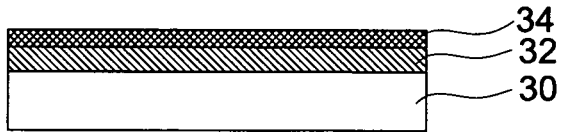
Figure 4:
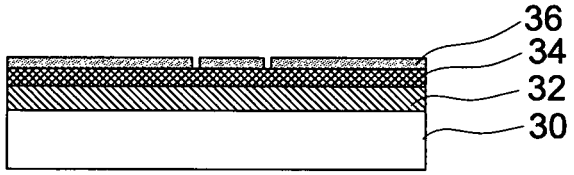
Figure 4:
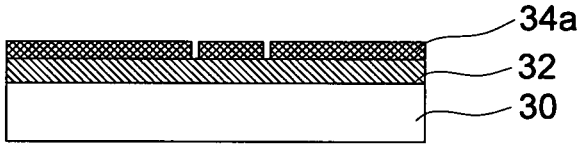
Figure 4:
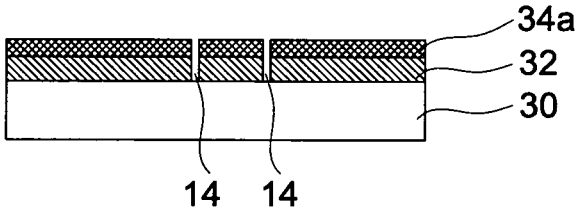
Figure 4:
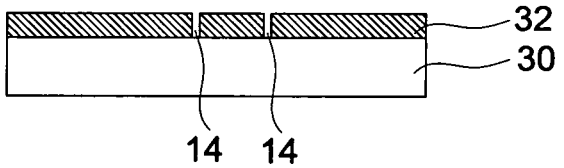
Figure 5:
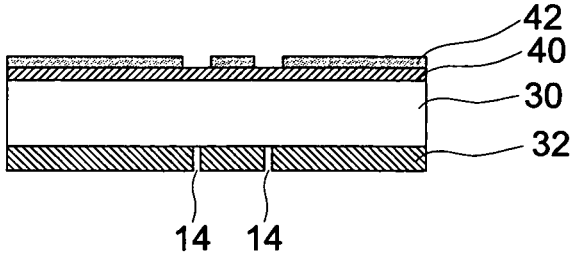
FIGS. 5(*a*) to 5(*e*) are views showing processes to form the large diameter portion.
Figure 5:
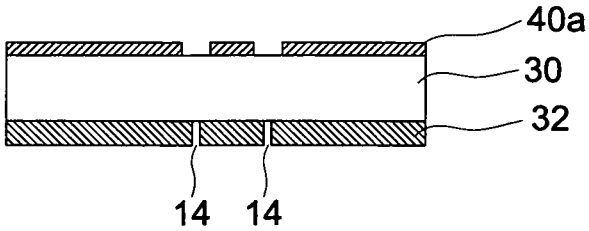
Figure 5:
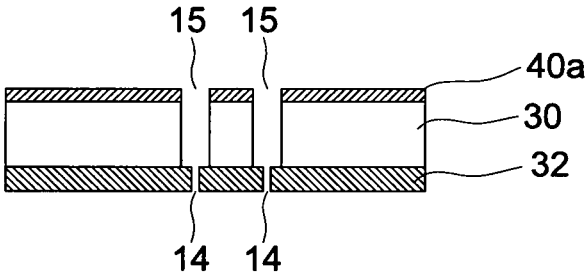
Figure 5:
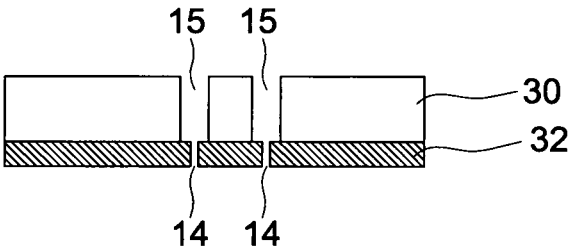
Figure 5:
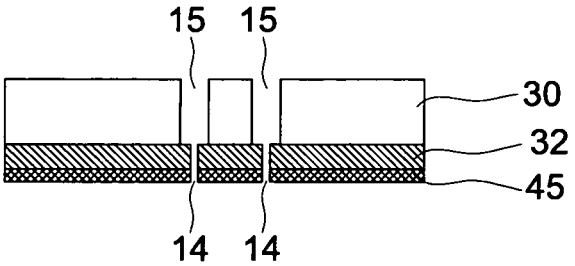

Manufacturing of nozzle plate 1 will now be described. FIGS. 4 and 5 schematically show an outline of the manufacturing processes of nozzle plate 1 by employing cross-sections, while FIG. 5(*d*) shows a completed nozzle plate. Further, FIG. 5(*e*) shows a nozzle plate preferably provided with liquid repellent layer 45.

Formation of small diameter portion 14, which is employed as a first process, will be described with reference to FIG. 4. In a substrate to be converted to nozzle plate 1, one side of a first base material is provided with a second base material. On Si substrate 30 which is the first base material, arranged is second base material 32 which forms small diameter portion 14 (FIG. 4(*a*)). It is necessary that the Si etching rate of components of second base material 32 during Si anisotropic dry etching is lower than that of Si etching. Further, preferred are materials capable of forming holes of about 1-about 10 μm via etching. Listed as such materials are, for example, insulating materials such as $SiO_2$ or $Al_2O_3$, metals such as Ni or Cr, and resins such as a photoresist. With regard to the etching rate in comparison to Si, when the Si rate is 1, $SiO_2$ and $Al_2O_3$ each is about 1/300-about 1/200, Ni and Cr each is about 1/500, and while resins such as a photoresist are about 1/50. Herein, an etching rate ratio wherein the Si rate is 1 is designated as the etching selection ratio. Since these etching selection ratios vary depending on etching conditions such as the etching apparatus or the etching rate, they are represented by an approximate value. As its numerical value decreases, it becomes possible to realize the predetermined length of small diameter portion 14 at desired accuracy.

When second base material 32, of a thickness which is identical to the length and thickness of small diameter portion 14, is arranged on Si substrate 30 by employing the above materials, forming methods are not particularly limited and include a vacuum deposition method, a sputtering method, a CVD method, and a spin coating method. Any of these methods may appropriately be selected. When the second base material is composed of $SiO_2$, one may be employed which is prepared by thermally oxidizing silicon substrate 30. Thickness of the second base material is not particularly limited. However, when it is excessively thick, channel resistance of nozzle 11 increases to raise drive voltage which is necessary for liquid droplet ejection. On the other hand, when it is excessively thin, strength is concerned. Consequently, it may appropriately be set to meet requirements.

A case, in which second base material 32 is composed of $SiO_2$ and small diameter portion 14 is arranged, will now be described. Initially, film 34 such as a Ni film, which is converted to etching mask 34*a*, is arranged on second base material 32 via a conventional vacuum deposition or sputtering method (FIG. 4(*b*)). Film 34 is not particularly limited as long as it becomes an etching mask during etching second base material 32. On film 34, formed is photoresist pattern 36 via a prior art photolithographic process (resist coating, exposure and development) to form etching mask 34*a* to form ejection hole 13 and small diameter portion 14 via a prior art photolithographic technology (FIG. 4(*c*)).

Subsequently, by employing above photoresist pattern 36 as a mask, any portions which are not masked are removed via a conventional reactive dry etching method employing chlorine gas to achieve patterning, whereby etching mask 34*a* is prepared. Thereafter, residual photoresist pattern 36 is removed via a conventional ashing method employing oxygen plasma (FIG. 4(*d*)).

Subsequently, by employing Ni etching mask 34*a*, small diameter portion 14, which passes through second base material 32, is formed via a conventional reactive dry etching method employing $CF_4$ gas (FIG. 4(*e*)). By allowing small diameter portion 14 to pass through second base material 32, when formation of large diameter portion 15 is completed, small diameter portion 14 and large diameter portion 15 are to be communicated. Detailed description will be made below in the description related to large diameter portion 15. It is to be noted that, no problem occurs in case the length of small diameter portion 14 becomes larger than the thickness of the second substrate to enter into Si substrate 30.

Subsequently, by removing etching mask 34*a*, small diameter portion 14 is completed in the $SiO_2$ layer, namely second base material 32 (FIG. 4(*f*)).

When second base material 32 is converted to a photoresist, formation of a photoresist pattern automatically results in formation of small diameter portion 14. Further, when second base material 32 is composed of metals such as Ni or Cr, it is possible to form small diameter portion 14 via dry etching employing oxygen plasma after forming a photoresist pattern on second base material 32.

Subsequently, formation of large diameter portion 15, which is referred to as a second process, will be described while referring to FIG. 5. Large diameter portion 15 is formed by employing Si substrate 30 provided with second base material 32, in which small diameter portion 14 is formed, and enables communicates with small portion 14. During arrangement of large diameter portions 15 in the case of arrangement of a plurality of large diameter portions 15, it is preferable that a diameter is realized which is capable of having a thickness which assures enough durability of partitions so that interference of applied pressure to the liquid, for example in the adjacent nozzles of large diameter portion 15 results in no problem. Further, it is preferable that appropriate determination is made while considering the pitch of intervals of small diameter portion 14.

Initially, on the surface of Si substrate 30 opposite the surface where second base material 32, carrying small diameter portions 14 exist, arranged is film 40 to be converted to an etching mask to arrange large diameter portions 15 via a conventional photolithographic process. Above film 40 is not particularly limited as long as it is converted to an etching mask during application of Si anisotropic dry etching to Si substrate 30, and an example thereof includes an $SiO_2$ film. To form a mask pattern on film 40, formed is photoresist pattern 42 via conventional photolithographic technology (FIG. 5(*a*)). Subsequently formed is etching mask 40*a* of $SiO_2$ via a conventional reactive dry etching method employing $CHF_3$ gas.

Subsequently, by employing an Si anisotropic dry etching method, formed are large diameter portions 15 in such a manner that penetration is achieved from the opposite surface on the side wherein small diameter portions 14 of Si substrate 30 are formed to at least small diameter portions 14 which are formed on the second base material and the entire cross-section of small diameter portions 14 is exposed. During the above, components of second base material 32, where small diameter portions are formed, exhibit a small etching selection ratio. Due to the above, during etching of large diameter portions 15, after etching reaches second base material 32, the resulting etching rate of second base material 32 decreases depending on the etching selection ratio.

Even though an etching amount (for example, when identical etching conditions are employed, it may be replaced by etching duration), which is necessary to form large diameter area 15, is determined via preliminary experiments, it is difficult to constantly make the length of formed large diameter portions 15 constant. For example, on identical Si substrates, fluctuation in the range of about ±5% results, though depending on the size of the substrate.

In order to allow each of formed large diameter portions 15 to communicate with each of corresponding small diameter portions 14 without fail, it is necessary to set a larger etching amount while assuming that within the fluctuation of the length during formation of large diameter portions 15, the length becomes shorter. However, an increase in the etching amount occasionally results in so-called over-etching in which large diameter portion 15 become excessively long. As a result, the length of small diameter portion 14 communicated with over-etched large diameter portion 15 becomes shorter than the predetermined length when the etching selection ratio of the component of small diameter portion 14 is assumed to be identical to Si (at an etching ratio of 1). A recording head carrying a nozzle plate carrying the above nozzles results in no improvement of printing quality.

When materials of a small etching selection ratio are employed as second base material 32, even during over-etching, the resulting etching rate of large diameter portion 15 is lowered at the time when reached to second base material 32, whereby etching is terminated. Accordingly, even though an over-etching state is formed by setting an etching amount to treat large diameter portion 15 in such a manner that an amount which considers treatment fluctuation is added to the predetermined amount, the treatment amount of the second base material due to over-etching is lowered, whereby it becomes possible to retard a decrease in the thickness of the second base material where small diameter portion 14 is formed.

For example, when second base material 32 is $SiO_2$, the etching selection ratio is small like as about 1/300-about 1/200. When it is temporarily 1/200, in the case of an over-etching amount of 10 μm, it is possible to retard the shortened amount of small diameter portion 14 under the over-etching amount to approximately 0.05 μm.

Since small diameter portion 14 passes through second base material 32, by forming large diameter portion 15 under the over-etching state as described above, large diameter portion 15 and small diameter portion 14 are communicated, whereby a targeted nozzle is completed in which the length of small diameter portion 14 is approximately identical to the thickness of the second substrate (FIG. 5(*c*)). Thereafter, photoresist pattern 42 and etching pattern 40*a* are removed, whereby a nozzle plate is completed (FIG. 5(*d*)). Photoresist pattern 42 may be removed immediately after formation of etching mask 40*a*.

In the above, the order of the first process to form small diameter portion 14 and the second process to form large diameter portion 15 may be replaced. Namely, as shown in FIG. 5, initially, large diameter portion 15 is formed on Si substrate 30 provided with second base material 32 by employing an Si anisotropic dry etching method in the same manner as above. In this case, small diameter portion 14 is not yet formed on the second base material. Subsequently, as shown in FIG. 4, on Si substrate 30 (in FIG. 4, large diameter portion 15 is not shown) provided with large diameter portion 15, small diameter portion 14 may be formed to pass through second base material 32 in the same manner as above.

After applying of nozzles onto above-mentioned Si substrate 30, liquid repellent layer 45 is arranged on the surface on the side on which ejection holes of Si substrate 30 are formed (FIG. 5(*e*)). Thereafter, after applying liquid repellent layer 45 on the surface on the side of Si substrate 30 through which ejection holes are formed (FIG. 5(*e*)), division is made to individual plates 1 employing a dicer.

Ejection surface 12 of nozzle plate 1 is flattened. By flattening ejection surface 12, processing of nozzle plate 1 becomes easy, and when employed while being incorporated in a recording head, it is possible to more easily carry out cleaning via wiping of ejection surface 12 where ejection hole 13 exists without any problem.

Liquid repellent layer 45 will now be described. It is preferable that liquid repellent layer 45 is arranged on the ejection surface where ejection hole 13 of nozzle plate 1 shown in FIG. 1 exists. By so arranging liquid repellent layer 45, it is possible to retard oozing and spreading of liquid from ejection hole 13 due to soaking on ejection surface 12. In practice, for example, when liquid is aqueous, water repellent materials are employed, while when liquid is oily, oil repellent materials are employed. However, in general, often employed are fluororesins such as FEP (ethylene tetrafluoride and propylene hexafluoride), PTFE (polytetrafluoroethylene), fluorocyloxane, fluoroalkylsilane, or an amorphous perfluororesin, any of which is filmed on ejection surface 12 via a method such as coating or deposition. Thickness of the thin film is not particularly limited. However, the employed thickness is preferably less than 100 nm since it is possible to reduce effects to the substantial nozzle length.

Further, as liquid repellent layer 45, it is possible to preferably employ one composed of a fluoroalkylsilane based monomolecular film. The film is formed on entire ejection surface 12 except nozzle hole 13 of nozzle 11. Fluoroalkylsilanes include those represented by the following formula.

$$R—Si—X_3$$

wherein X represents a hydrolyzable group which is preferably an alkoxy group having 1-5 carbon atoms, while R represents a fluorine-containing organic group which is preferably a fluoroalkyl group having 1-20 carbon atoms.

When one composed of the fluoroalkylsilane based monomolecular film is employed, it is possible to prepare a liquid repellent film which results in minimal degradation during storage due to its chemical bond with the base material.

In addition, liquid repellent layer 45 may be formed directly on ejection surface 12 of nozzle plate 1, or via an intermediate layer to enhance closer adhesion of liquid repellent layer 45.

In addition, the cross-sectional shape nozzle 11 is not limited to a circular shape, and instead of the circular shape, a cross-sectional polygon shape or a cross-sectional star shape may be acceptable. When the cross-sectional shape is not circular, for example, the term "large diameter greater than small diameter" means that the diameter of a circle which has the same area as that of the large diameter portion is greater than the diameter of a circle which has the same area as that of the small diameter portion.

As shown in FIG. 1, body plate 2 is provided with a plurality of pressurizing chamber grooves 24 converted to pressurizing chambers, each of which communicates with nozzle 11, a plurality of ink feeding grooves 23 converted to ink feeding channels, each of which communicates with the above pressurizing chamber, common ink chamber groove 22 converted to a common ink chamber which communicates with the above ink feed, and ink feeding opening 21. These grooves are formed, for example, on a specially prepared Si substrate via a conventional photolithographic process (resist coating, exposure and development) and an Si anisotropic dry etching technology, whereby body plate 2 is prepared.

Channel unit M is formed via adhesion of nozzle plate 1 and body plate 2 so that nozzles 11 of nozzle plate 1 and pressurizing chamber grooves of body plate 2 correspond one-to-one.

Recording head A is completed via adhesion of piezoelectric element 3, as an actuator for ink ejection, to the rear surface of bottom portion 25 of each pressurizing chamber 24 opposite the surface adhered by nozzle plate 1 of body plate 2.

It is possible to apply nozzle plate 1, described above, to the so-called electric field assist type liquid ejection head which ejects liquid droplets utilizing action of electrostatic force.

Figure 6:
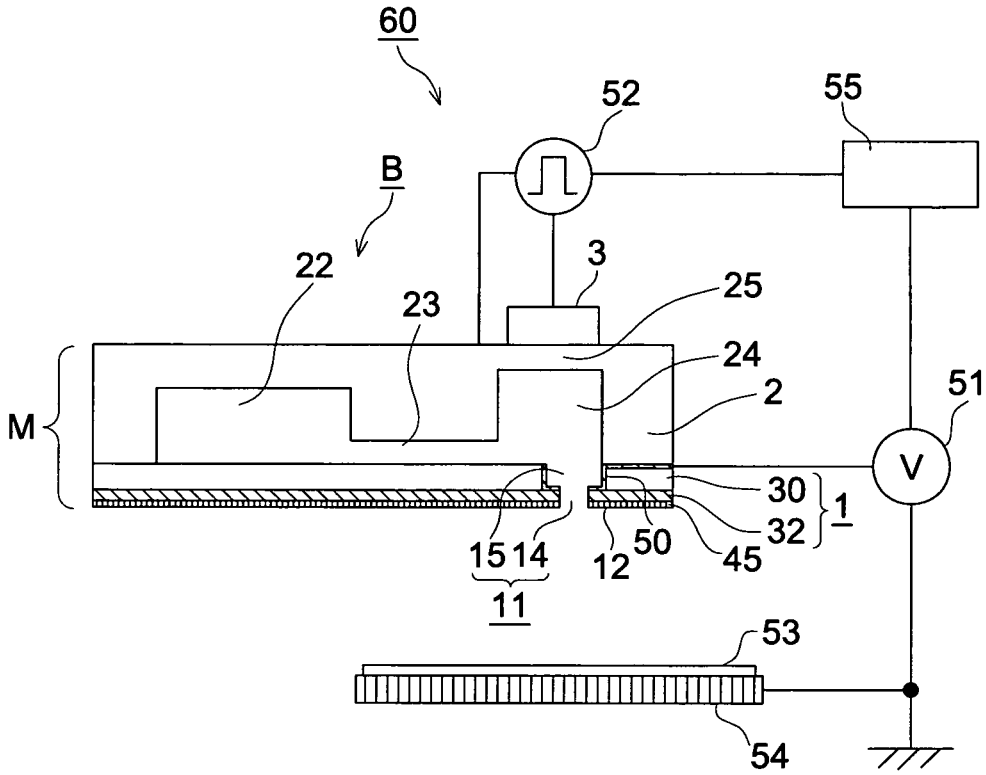
FIG. 6 is a schematic view showing the entire constitution of a liquid ejection apparatus constituted by employing an electric field assist type liquid ejection head.

In FIG. 6 schematically shown is the overall constitution of liquid ejection apparatus 60 which is constituted by employing electric field assist type liquid ejection head B (liquid ejection head B). Charging electrode 50, which is composed of electrically conductive components such as NiP, Pt, or Au, and which is an electrostatic voltage applying means to charge liquid into the nozzle, is arranged, for example, on the inner peripheral surface of large diameter portion 15 of nozzle plate 1 which is employed in liquid ejection head B. By arranging charging electrode 50, above charging electrode 50 is brought into contact with liquid in large diameter portion 15 of nozzle plate 1. When electrostatic voltage is applied, from electrostatic voltage source 51, between charging electrode 50 and counter electrode 54 provided with substrate 53 to be deposited by ejected liquid droplets, the liquid in large diameter portions is simultaneously charged. Via the above charging, it possible to generate electrostatic attractive force between nozzle hole 11 of the liquid ejection head and counter electrode 54, arranged in the facing position, specifically between the liquid and base material 53 deposited by ejected droplets.

As liquids which are ejected to form droplets, listed may be inorganic liquids such as water, organic liquids such as methanol, and electrically conductive pastes which incorporate a large amount of materials (such as silver powder) of high electrical conductivity.

In the rear surface portion corresponding to each pressurizing chamber 24, arranged respectively is piezoelectric element 3 which is a piezoelectric element actuator as a pressure generating means. Piezoelectric element 3 is connected to drive voltage power source 52 so that drive voltage is applied to piezoelectric element 3 to deform piezoelectric element 3. Piezoelectric element 3 is deformed via application of drive voltage from drive voltage power source 52 so that liquid in the nozzle is pressurized to form a meniscus of the liquid at ejection hole 13 of nozzle 11. As described above, by arranging liquid repellent layer 45 on ejection surface 12 in the presence of ejection hole 13, it is possible to effectively minimize any decrease in electric field concentration to the meniscus tip portion due to spread of the liquid meniscus formed in the nozzle ejection hole 13 portion, over ejection surface 12 in the periphery of ejection hole 13. In addition, 55 is a control section which controls liquid ejection apparatus 60 such as drive voltage power source 52 or electrostatic voltage power source 51.

Accordingly, it is possible to prepare an electric field assist type liquid ejection head capable of efficiently ejecting liquid droplets via synergic effects of the pressure applied to the liquid via piezoelectric element 3 and the electrostatic attractive force to the liquid via charging electrode 50.

Another embodiment of a liquid ejection apparatus employing the nozzle plate according to the present invention will now be described with reference to the drawings, however the scope of the present invention is not limited to the examples in the drawings.

Figure 7:
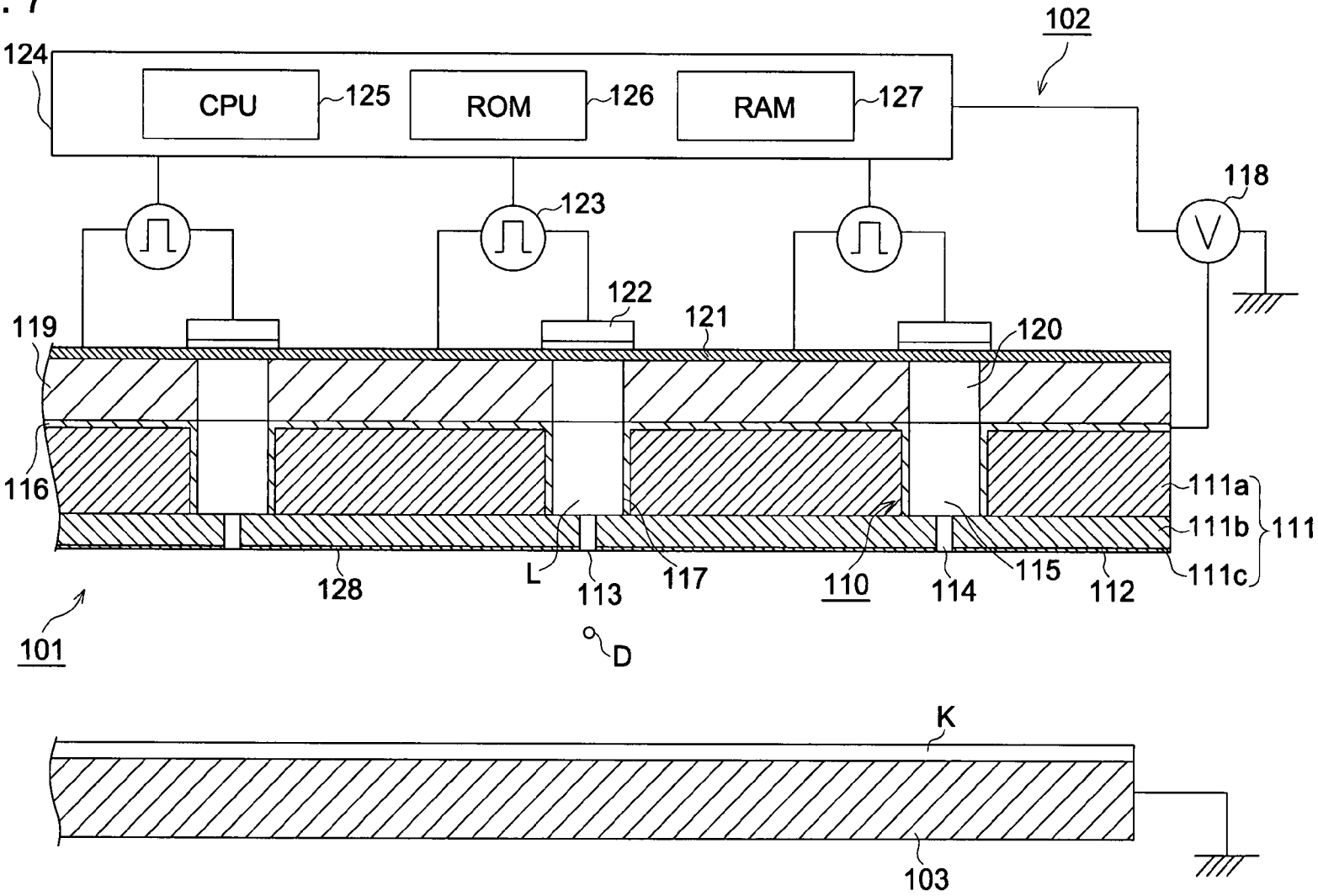
FIG. 7 is a cross-sectional view showing schematic constitution of the liquid ejection apparatus according to the present embodiment.

FIG. 7 is a cross-sectional view showing the entire constitution of the liquid ejection apparatus according to the first embodiment. In addition, it is possible to apply liquid ejection head 102 and liquid ejection apparatus 101 to various liquid ejection apparatuses such as so-called serial or line systems.

Liquid ejection apparatus 101, according to the present embodiment, incorporates liquid ejection head 102, incorporating a plurality of nozzles 110, each of which ejects liquid droplet D of liquid L such as an electrically chargeable ink, and counter electrode 103 which not only carries a facing surface which faces nozzles 110 of liquid ejection head 102 but also supports base material K which results in deposition of liquid droplet D on its facing surface.

In liquid ejection head 102, on the side facing counter electrode 103, arranged is nozzle plate 111 which is employed in liquid ejection head 102 and in which a plurality of nozzles 110 is formed which ejects liquid droplets from ejection hole 113. Nozzle plate 111 according to the present embodiment is provided with $SiO_2$ film 111*b* and liquid repellent film 111*c* at a thickness of less than 100 nm in the above order on one surface on counter electrode 103 side of silicon substrate 111*a*. Further, nozzles 110 formed on nozzle plate 111 are formed as a two-step structure provided with large diameter portion 115 which passes through silicon substrate 111*a*, and small diameter portion 114 which passes through both $SiO_2$ film 111*b* and liquid repellent film 111*c*. Accordingly, liquid ejection head 102 is constituted as a head carrying a flat ejection surface so that nozzles 110 do not project from ejection surface 112 which faces counter electrode 103 of nozzle plate 111 and base material K.

Small diameter portion 114 and large diameter portion 115 of each nozzle 110 are formed to be columnar.

With regard to the nozzle diameter, it is preferable that the internal diameter of small diameter portion 114 becomes at most 10 μm, and the dimensions of portions other than nozzles 110 may be appropriately set as required.

On the nozzle plate, formed is liquid repellent film 128. One example of its forming method includes a method while ejecting air from nozzles 110 so that liquid repellent agents result in no penetration into nozzles 110, a coating liquid, in which fluoroalkylsilane is dissolved, is applied and dried and thereafter, the resulting coating is sufficiently sintered to form a monomolecular film. In addition, forming methods of liquid repellent film 128 are not particularly limited, and it is possible to prepare the film by employing methods such as a coating method employing rollers such as a reverse roller coater, a coating method employing blades, or a CVD (Chemical Vapor Deposition) method. Further, in order to minimize penetration of liquid repellent agents into nozzles 110, it may be acceptable that a film is prepared in such a state in which liquid L is filled in nozzles 110.

On the surface on the side opposite ejection surface 112 of nozzle plate 111, arranged is laminated charging electrode 116 composed of electrically conductive components such as NiP, to charge liquid L in nozzles 110. In the present embodiment, charging electrode 116 is arranged to reach internal peripheral surface 117 of large diameter portion 115 of nozzle 110 to come into contact with liquid L in the nozzle.

Further, charging electrode 116 is connected to charging voltage power source 118 as an electrostatic voltage applying means which applies electrostatic voltage to generate an electrostatic attractive force. In the present embodiment, charging electrodes 116 is individually brought into contact with liquid L in each of nozzles 110, whereby when electrostatic voltage is applied to charging electrodes 116 from charging voltage power source 118, liquid L in all nozzles 110 is simultaneously charged so that an electrostatic attractive force is generated between liquid L in nozzles 110 or cavities 120 described below and base material K supported by counter electrode 103.

In the rear of charging electrodes 116, arranged is body plate 119. In the portion facing the aperture edge of large diameter portion 115 of each nozzle 110 of body plate 119, formed is an approximately cylindrical space having the approximately identical inner diameter at each aperture edge, and each space is employed as cavity 120 to temporarily store liquid L ejected from ejection hole 113 of nozzles 110.

In the rear of body plate 119, arranged is flexible layer 121 composed of a thin metallic plate and silicon, which exhibit flexibility, and via flexible layer 121, liquid L in liquid ejection head 102 is prevented from no leaking to the exterior.

In addition, in body plate 119, formed are channels, not shown, to feed liquid L to cavities 120. In practice, a silicon plate as body plate 119 is etched whereby cavities 120, a common channel, not shown, and channels which connect the common channel with cavities 120 are arranged. The common channel is connected with a feeding pipe, not shown, which feeds liquid L from a liquid tank, not shown, on the exterior, and an arrangement is made so that a specified feeding pressure is applied to liquid L in the channels, cavities 120, and nozzles 110 via a feeding pump, not shown, or differential pressure due to the arranged position of the liquid tank.

In the present embodiment, in the portion corresponding to each cavity 120 on the external surface of flexible layer 121, arranged is piezoelectric element 122 which is a piezoelectric element actuator as each of the pressure generating means. Piezoelectric element 122 is electrically connected to drive voltage power source 123 to deform the above element via application of drive voltage to the above element.

Piezoelectric element 122 is deformed via applied drive voltage from drive voltage power source 123 to allow liquid L in nozzles to generate pressure, whereby a meniscus of liquid L is formed at ejection hole 113 of each nozzle 110. In addition, other than the piezoelectric element actuator, as employed in the present embodiment, it is possible to employ, for example, an electrostatic actuator or a thermal system.

Drive voltage power source 123 and aforesaid charging voltage power source 118 each is connected to operation control means 124 and each is controlled via operation control means 124.

In the present embodiment, operation control means 124 is composed of a computer which is constituted in such a manner that CPU125 and ROM126, and RAM127, are connected via BUS, not shown. An arrangement is made as follows. CPU125 drives charging voltage power source 118 and each drive voltage power source 123, based on power source control programs stored in ROM126 so that liquid L is ejected from ejection hole 113 of nozzles 110.

In practice, based on power source control programs, operation control means 124 controls application of electrostatic voltage to above charging electrode 116 via charging voltage power source 118 which is an electrostatic voltage applying means so that liquid L in nozzles 110 and cavities 120 is charged to generate an electrostatic attractive force between liquid L and base material K. Further, based on power source control programs, operation control means 124 drives each drive voltage power source 123 to deform each piezoelectric element 122, followed by to generation of pressure in liquid L in nozzles 110 so that a meniscus of liquid L is formed at ejection hole 113 of each nozzle 110.

Below liquid ejection head 102, arranged is tabular counter electrode 103, which supports base material K on the rear surface, in parallel with ejection surface 112 of liquid ejection head 102, while being separately arranged at a predetermined distance. The separate distance between counter electrode 103 and liquid ejection head 102 is appropriately set to be in the range of about 0.1-about 3 mm.

In the present embodiment, counter electrode 103 is grounded and is always maintained at ground potential. Due to that, when electrostatic voltage is applied to charging electrode 116 from above charging voltage power source 118, potential difference is formed between liquid L in ejection hole 113 of nozzle 110 and the surface facing liquid ejection head 102 of counter electrode 103, whereby an electric field is generated. Further, when charged liquid droplet D is deposited onto base material K, counter electrode 103 lets out the resulting electric charges via grounding. In addition, grounding methods of counter electrode 103 are not limited to the present embodiment. Charging electrode 116 may be grounded, and electrostatic voltage may be applied to counter electrode 103.

Counter electrode 103 or liquid ejection head 102 is provided with a positioning means, not shown, which achieves positioning by relatively displacing liquid ejection head 102 and base material K. By employing the above, liquid droplet D can be deposited at any position on the surface of base material K.

As liquid L capable of being ejected from liquid ejection apparatus 101, employed may be conventional liquids without any specific limitation.

Further, as liquid L, it is possible to employ electrically conductive pastes which incorporate a large amount of compounds of high electrical conductivity such as silver powders. Still further, targeted compounds, which are employed to be dissolved or dispersed in above liquid L, are not particularly limited, as long as coarse particles which generate clogging of nozzles are removed.

In addition, it is possible to employ, without any limitation, compounds which are conventionally known as phosphors, which are employed in PDP (Plasma Display Panel), CRT (Cathode Ray Tube), or FED (Field Emission Display). For example, as red phosphors listed are (Y,Gd) $BO_3$:Eu and $YO_3$:Eu; as green phosphors listed are $Zn_2SiO_4$:Mn, $BaAl_{12}O_{19}$:Mn, and (Ba,Sr,Mg)O-α-$Al_2O_3$:Mn; and as blue phosphors listed are $BaMgAl_{14}O_{23}$:Eu and $BaMgAl_{10}O_{17}$:Eu.

In order to allow the above targeted compounds to tightly adhere to base material K, incorporated may be various binders. As employed binders, employed may be conventional resin compounds without any specific limitation. Resin compounds include not only homopolymers but also those which are blended within their compatible range.

When liquid ejection apparatus 101 is employed as a patterning means, it is possible to employ it for the use of display as representative one. In practice, listed may be formation of PDP phosphors, formation of PDP ribs, formation of PDP electrodes, formation of CRT phosphors, formation of FED phosphors, formation of FED ribs, formation of color filters such as an RBG colored layer for LCD (Liquid Crystal Display) and a black matrix layer, and formation of spacers for LCD such as a pattern corresponding to a black matrix and a dot pattern. "Rib", as described herein, generally means a barrier, and when PDP is taken as an example, it is employed to separate the plasma region of each color.

Other uses of the present embodiment may include microlenses, patterning coating of magnetic materials, ferroelectric materials, and electrically conductive pastes which are converted to wiring or antenna, as uses for semiconductors, normal printing, printing onto special media such as film, cloth, and steel plate, curved surface printing, press plates of various printing plates, as graphic uses, coating of adhesive materials and sealing materials, as processing uses, and coating of medical products in which a plurality of minute components is blended and samples for gene diagnosis, as bio and medical uses.

Now, the ejection principle of liquid L in liquid ejection head 102 according to the present embodiment will be described.

In the present embodiment, electrostatic voltage is applied to charging electrode 116 from charging voltage power source 118 so that an electric field is generated between liquid L in ejection hole 113 of all nozzles 110 and the surface facing liquid ejection head 102 of counter electrode 103. Further, drive voltage is applied to piezoelectric element 122 corresponding to each nozzle 110 to eject liquid L via drive voltage power source 123 to deform piezoelectric element 122, whereby a meniscus of liquid L in ejection hole 113 of nozzles 110 is formed via the pressure applied to liquid L (refer to FIG. 8).

Figure 8:
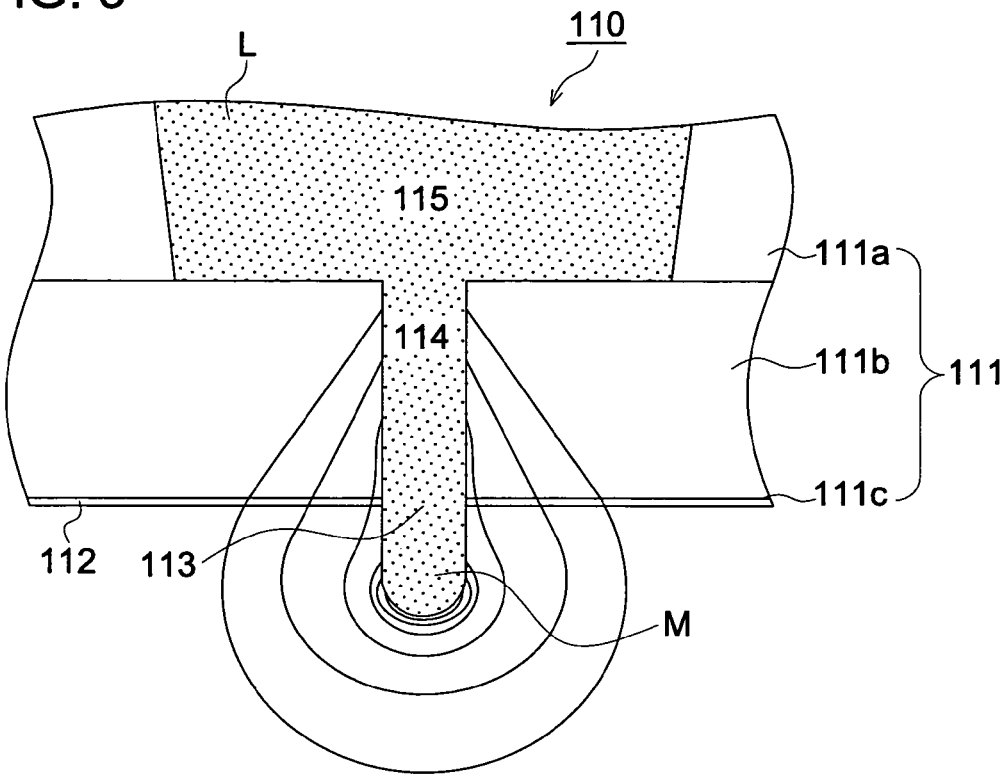
FIG. 8 is a schematic view showing the electric potential distribution near the ejection hole of a nozzle.

During the above operation, as shown in FIG. 8, equal electric potential lines are formed in approximately the vertical direction in the interior of nozzle plate 111 to ejection surface 112, and a strong electric field is generated which directs to liquid L in small diameter portion 114 of nozzle 110 and meniscus M.

Specifically, as seen in FIG. 8, the identical potential lines at the tip portion of the meniscus M are dense, and at the tip portion of meniscus M, the electric field is significantly concentrated. Consequently, meniscus M is torn off due to a strong electrostatic force of the electric field, followed by separation from liquid L in the nozzle to form liquid droplet D. Further, resulting liquid droplet D is accelerated via an electrostatic force and attracted by base material K supported by counter electrode 103, to achieve deposition. At that time, since liquid droplet D tends to be deposited onto the nearer position, the angle to base material K during deposition is stabilized, whereby accurate deposition is achieved.

Further, when meniscus M formed in ejection hole 113 of nozzle 110 spreads onto ejection surface 112, the electric field concentration at the tip portion of meniscus M is weakened.

However, in the present embodiment, since liquid repellent film 111*c* is formed on ejection surface 112, spreading of liquid L on ejection surface 112 is minimized to result in no decrease in the electric field concentration at the tip portion of meniscus M.

As described above, by utilizing the ejection principle of liquid L in liquid ejection head 102 according to the present embodiment, even in liquid ejection head 102 having a flat ejection surface, it is possible to achieve high electric field concentration by employing nozzle plate 111 with high volume resistance and by generating electric potential difference in the vertical direction to ejection surface 112, whereby an accurate and stable ejection state of liquid L is achieved. Further, it is possible to assuredly and appropriately form meniscus M via liquid repellent film 111*c* and to reduce fluctuation of the nozzle length in small diameter portion 114, whereby it is possible to enhance ejection performance.

Figure 9:
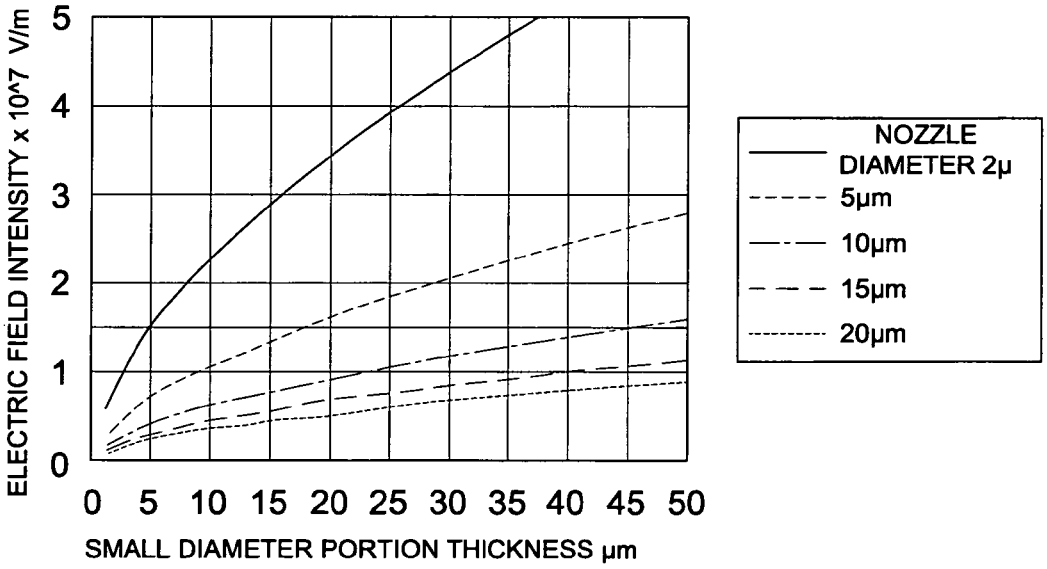
FIG. 9 is a view showing the relationship between the electric field intensity at the tip portion of a meniscus and the thickness of the small diameter portion.
Figure 10:
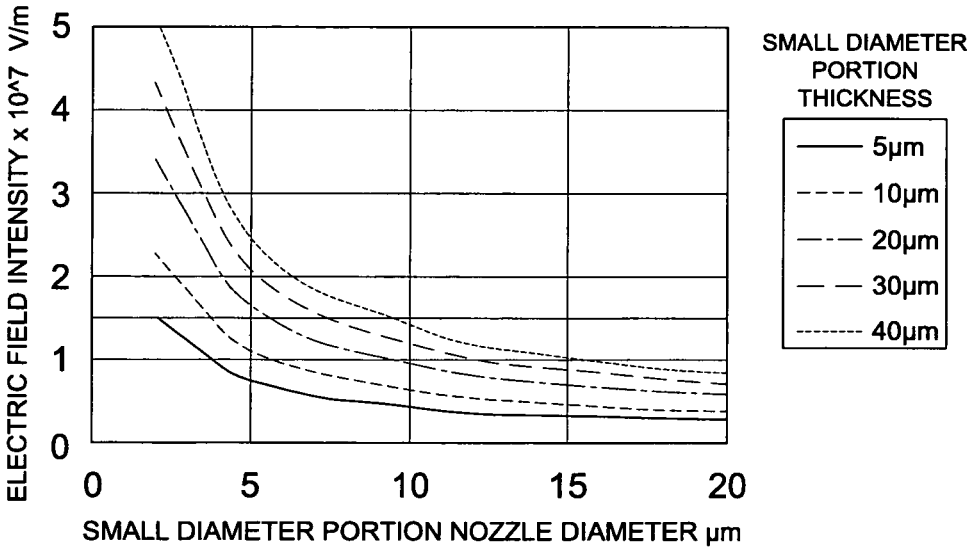
FIG. 10 is a view showing the relationship between the electric field intensity at the tip portion of a meniscus and the nozzle diameter.

The inventors of the present invention conducted experiments and simulation experiments employing nozzle plate 111 composed of various insulators. As a result, it was found that the electric field intensity at the tip portion of meniscus M depended on the nozzle diameter and the thickness of insulators, and the electric field intensity, which was necessary for liquid droplet ejection, was approximately $1.5\times10^7$ V/m. In more detail, it is possible to realize the concentrated electric field intensity which is necessary for electric field concentration ejection in such a manner that based on to FIGS. 9 and 10, when the nozzle diameter (being the internal diameter of the small diameter portion) is 10 μm, the thickness of insulating $SiO_2$ film 111*b* is set to be at equal to or more than 45 μm, and when the nozzle diameter is 5 μm, the thickness of $SiO_2$ film 111*b* is set to be at equal to or more than 20 μm, while when the nozzle diameter is 2 μm, the thickness of $SiO_2$ film 111*b* is set to be at equal to or more than 5 μm. Incidentally, simulation experiments were conducted employing simulation via an electric current distribution analysis mode in "PHOTO-VOLT" (being a trade name, produced by Photon Co., Ltd.), which is an electric field simulation software.

Actions of liquid ejection head 102 and liquid ejection apparatus 101 according to the present embodiment will now be described.

Figure 11:
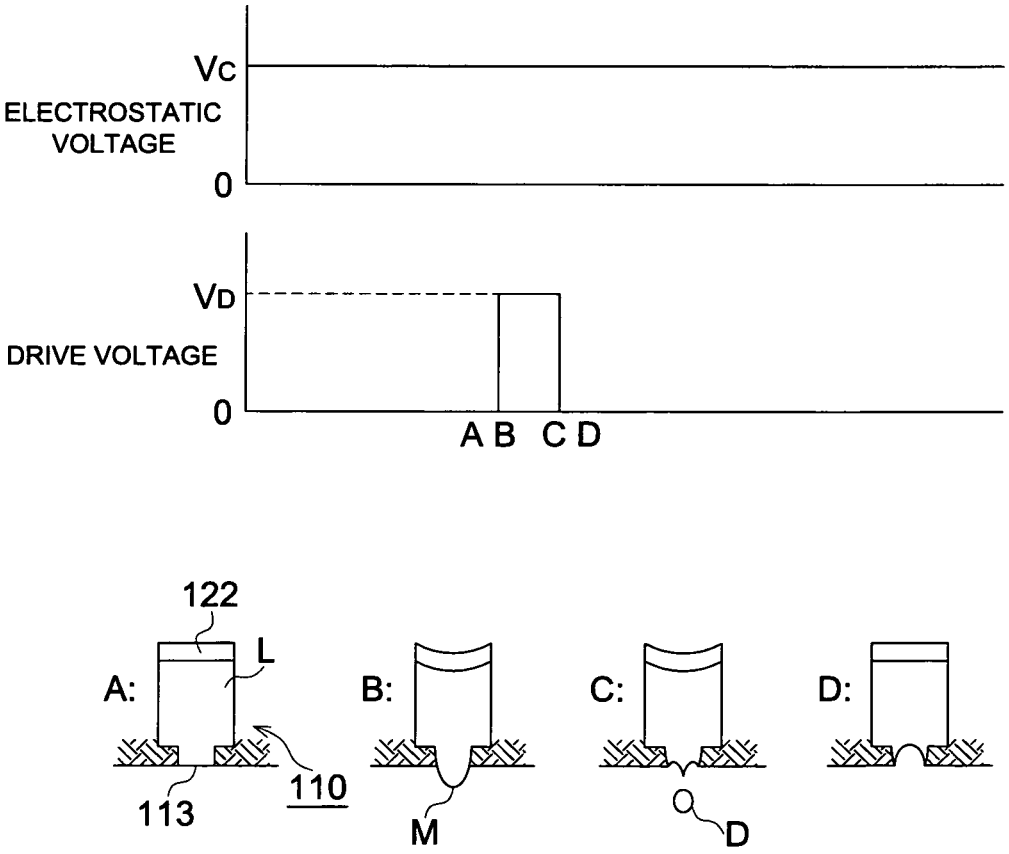
FIG. 11 is a view showing one example of the drive control of a liquid ejection head.

FIG. 11 is a view to describe a drive control of the liquid ejection head in the liquid ejection apparatus according to the present embodiment. In the present embodiment, constant electrostatic voltage Vc is applied to charging electrode 116 from charging voltage power source 118 via operation control means 124 of liquid ejection apparatus 101. By doing so, constant electrostatic voltage Vc is always applied to each nozzle 110 of liquid ejection head 102, whereby an electric field is generated between liquid L in liquid ejection head 102 and base material K supported by counter electrode 103.

Further, simultaneously, in the vicinity of ejection hole 113 of nozzles 110, identical electric potential lines are formed side by side in the approximately vertical direction to ejection surface 112 in the interior of nozzle plate 111, whereby a strong electric field is generated which directs to liquid L in small diameter portion 114 of nozzles 110.

In addition, when pulsed drive voltage $V_D$ is applied, via operation control means 124, to piezoelectric element 122 which corresponds to each nozzle 110 to eject liquid droplet D, piezoelectric element 122 is deformed whereby pressure of liquid L in the nozzle increases and in ejection hole 113 of nozzle 110, meniscus M is lifted up from the state A in FIG. 11(A), and as sate B in FIG. 11 shows, a state is formed in which meniscus M is significantly lifted up.

At that time, since in the present embodiment, fluorinated alkylsilane repellent film 111*c* is formed on ejection surface 112 of nozzle plate 111, meniscus M formed in ejection hole 113 of each nozzle 110 is not spread onto ejection surface 112, whereby lifted meniscus M is maintained.

At the tip portion of meniscus M lifted as above, electric field concentration is advanced and electric field intensity becomes very high. As a result, strong electrostatic force from the electric field formed by above electrostatic voltage Vc is applied to meniscus M. Thus, as state C in FIG. 11 shows, the meniscus is torn off via attraction due to the above strong electrostatic force, whereby minute liquid droplet. D at a diameter of about 1-about 10 μm is formed. Resulting liquid droplet D is accelerated via the electric field, attracted to the counter electrode direction, and deposited onto base material K supported by counter electrode 103.

During that operation, though air resistance is applied to liquid droplet D, as described above, liquid droplet D tends to be deposited onto the nearer position via the action of electrostatic force. As a result, the deposition direction to base material K is not deviated, and stable deposition is accurately carried out onto base material K. Further, as state D in FIG. 11(D) shows, in nozzles 110, the liquid surface results in setback by the torn-off amount, but liquid L is replenished from cavity 120 followed by rapid return to the state A of FIG. 11.

Figure 12:
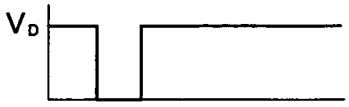
FIGS. 12(*a*) to 12(*c*) are views showing a variant example of drive voltage applied to a piezoelectric element.
Figure 12:
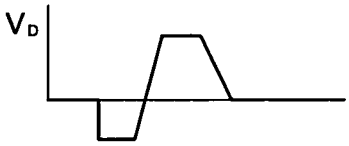
Figure 12:
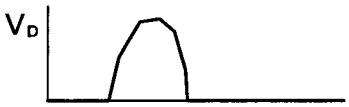

In addition, as drive voltage $V_D$ applied to piezoelectric element 122, it is possible to make it a pulse voltage as employed in the present embodiment. However, other than the above, it is possible to achieve a constitution in which a voltage such as so-called triangular voltage is applied in which after gradual increase in voltage, it gradually decreases a trapezoidal voltage is applied in which after gradual increase in voltage, it is once kept at a constant value and thereafter gradually decreases, or a sine wave voltage is applied. Further, it may be constituted in such a manner that as shown in FIGS. 12(A) and 12(C), under constant application of voltage $V_D$ to piezoelectric element 122, the application is once terminated, and voltage $V_D$ is again applied so that at the initial rise, liquid droplet D is ejected. Further, constitution may be achieved so that as shown FIGS. 12(B) and 12(C), various drive voltages are applied. The constitution is appropriately determined.

As described above, by employing nozzle plate 111 and liquid ejection apparatus 102 according to the present embodiment, even in nozzles 110 each having small ejection hole 113 at an internal diameter of small diameter portion 114 of less than 10 μm and by forming liquid repellent film 111*c* at a thickness of less than 100 nm, it is possible to minimize fluctuation of the nozzle diameter due to entrance of liquid repellent film 111*c* into ejection hole 113, and in addition, to retard fluctuation of the nozzle length due to fluctuation of thickness of liquid repellent film 111*c*, whereby it is possible to avoid adverse effects to the ejection of liquid droplets. As described above, since it is possible to retard the fluctuation of the nozzle length, the fluctuation of the lifted amount of meniscus M formed in ejection hole 113 of nozzles 110 is retarded, whereby it becomes possible to maintain the electric field intensity of the tip portion at a constant value. Further, since liquid repellent film 111*c* is formed to be thinner, it is possible to make the nozzle length shorter, whereby it is possible to retard an increase in channel resistance in nozzles 110, and also to retard an increase in pressure applied to liquid L in nozzles 110 during ejection of liquid droplets.

Further, since via liquid repellent film 111*c*, it is possible to avoid spread of liquid L from ejection hole 113 of nozzles 110 and adhesion of ejected liquid droplet D to ejection surface 112, the electric field intensity at the tip portion of meniscus M is not disturbed, whereby it is possible to further enhance ejection performance.

Still further, since it is possible to precisely form nozzles 110 carrying small ejection hole 113 at an internal diameter of the small diameter portion of less than 10 μm, it is possible to employ them in an electric field concentration system liquid ejection heads for highly concentrated electric field intensity.

Still further, being provided with silicon substrate 111*a* and $SiO_2$ film 111*b* which differ in the etching rate, it is possible to easily form large diameter portions 115 and small diameter portions 114 by etching each surface side of nozzle plate 111.

In addition, by forming fluorosilane based liquid repellent film 111*c* on the ejection surface side of $SiO_2$ film 111*b*, it is possible to convert it to a preferred monomolecular film. Further, by employing fluorosilane based liquid repellent film 111*c*, it is possible to convert it to nozzle plate 111 which results in no change of repellency with age.

In addition, in the present embodiment, constitution is made so that meniscus M is lifted up via deformation of piezoelectric element 122. Any pressure generating means may be employed which is capable of lifting up meniscus M as described above. Other than these, constitution may be acceptable in which, for example, air bubbles are formed by heating liquid L in nozzles 110 and cavities 120 and the resulting pressure is utilized.

Further, in the present embodiment, described is the case in which counter electrode 103 is grounded. However, a constitution is also employable in which, for example, voltage is applied to counter electrode 103 from the power source and the power source is controlled via operation control means 124 so that electric potential difference reaches the predetermine value such as 1.5 kV.

EXAMPLES

Example 1

An example to manufacture nozzle plate 1 will now be described, employing FIGS. 4 and 5. Initially, formation of small diameter portions 14 is described with reference to FIG. 4. On one surface of 200 μm thick Si substrate 30, formed was a 5 μm thick $SiO_2$ film as second base material 32 (FIG. 4(*a*)). Plasma CVD was employed as the forming method.

Subsequently, a 0.3 μm thick Ni film which was film 34 converted to etching mask 34*a* was formed via a sputtering method (FIG. 4(*b*)). On the Ni film was formed photoresist pattern 36 via a photolithographic process (FIG. 4*c*)). Thereafter, formed was a Ni film pattern, which was etching mask 34*a* to form, on the $SiO_2$ film which was second base material 32, small diameter portions 14 at a diameter of 5 μm, carrying ejection holes as openings via etching (FIG. 4(*d*)).

By employing etching mask 34*a*, the $SiO_2$ film, which was second base material 32, was subjected to dry etching in which $CF_4$ was employed as the reaction gas, whereby small diameter portions 14 were formed (FIG. 4(*e*)). The etching amount to form small diameter portions 14 was obtained via preliminary experiments. However, upon considering the fluctuation range of the etching amount, 5.5 μm was employed while increased by 0.5 μm (10%). By increasing the etching amount by 10%, small diameter portions 14 resulted in a state in which the $SiO_2$ film, which was second base material 32, was passed trough. Though over-etching of the above small diameter potions 14 affects Si substrate 30, no problem occurs by later arranging large diameter portions 15 on the side of Si substrate 30.

Large diameter portions 15 will now be described with reference to FIG. 5. On the surface of the side opposite to the side provided with Si substrate 30 where small diameter portions 14 were arranged, formed was 1 μm thick $SiO_2$ film which was film 40 prepared by the same method as for second base material 32. On above $SiO_2$ film, formed was photoresist pattern 42 (FIG. 5(*a*)). By employing above photoresist pattern 42, etching was carried out, whereby etching mask 40*a* composed of $SiO_2$ was prepared (FIG. 5(*b*)).

By employing etching mask 40*a*, Si substrate 30 was subjected to Si anisotropic dry etching, whereby large diameter portions 15 were formed. The etching amount to form large diameter portions 15 was previously determined via experiments, and upon considering the fluctuation range of the etching amount, 210 μm was determined. Further, the $SiO_2$ etching selection ratio, which was previously obtained via experiments, was 1/200. Accordingly, when 200 μm thick Si substrate 30 was subjected to Si anisotropic dry etching, excess length of the large diameter portion due to over-etching to the $SiO_2$ second base material, in which small diameter portions 14 were formed, became 0.05 μm. As a result, a nozzle hole was completed in which large diameter portion 15 was passed through small diameter portion 14 without any problem and the length of small diameter portion 14 (being the nozzle length) was almost as specified (FIG. 5(*c*)).

Subsequently, $SiO_2$ film, converted to etching mask 40*a*, was removed via a reactive ion etching method (RIE) (FIG. 5(*d*)).

Further, as a liquid repellent processing agent, a 1% trichlorotrifluoroethane solution of undecafluoropentyltrimethoxysilane was prepared and applied onto the $SiO_2$ film where the small diameter portions were formed. Thereafter, heating at 120° C. for 30 minutes was carried out, whereby liquid repellent film was formed (FIG. 5(*e*)).

Si substrate 30 carrying the nozzle holes, formed via the above steps, was separated via a dicing saw, whereby nozzle plate 1, carrying nozzle holes, was prepared.

Subsequently, body plate 2, shown in FIG. 1, was produced. By employing the Si substrate, formed were a plurality of pressurized chamber grooves converted to pressurized chambers, each of which communicated with the nozzle, a plurality of ink feeding grooves converted to ink feeding channels, each of which communicated with the above pressurized chamber, a common ink chamber groove converted to a common ink chamber which communicated with the above ink feed, and an ink feeding hole, by employing a conventional photolithographic process (resist coating, exposure, and development) as well as Si anisotropic dry etching technology.

Subsequently, as shown in FIG. 1, nozzle plate 1 and body plate 2, prepared as above, were adhered to each other via adhesives, and further, piezoelectric element 3, which was a pressure generating means, was fitted to the rear surface of each pressurized chamber 24 of body plate 2, whereby liquid droplet ejection head A was prepared. When liquid droplet ejection head A was operated, it was confirmed that it was possible to stably eject ink without fluctuation.

Example 2

The liquid ejection apparatus according to the present invention was prepared by employing each of the nozzle plates in which the thickness of the $SiO_2$ film, where the small diameter portions were formed and the diameter of the small diameter portions in Example 1 were variously changed (Embodiment 1 in Table 1). Incidentally, 16 nozzles were formed in one nozzle plate.

Further, the liquid ejection apparatus according to the present invention was prepared employing a nozzle plate in which the liquid repellent film was replaced with a 2 μm thick one employing fluorine based liquid repellent agents (Embodiment 2 in Table 1).

By employing the liquid ejection apparatus prepared as above, ejection performance was evaluated. A liquid to be ejected was an ink incorporating 52% by weight of water, 22% by weight of ethylene glycol, 22% by weight of propylene glycol, 3% by weight of a dye (CI Acid Red 1), and 1% by weight of surface active agents. Further, the ejection performance was evaluated as follows. Initially, after continuously driving all liquid ejection heads over 24 hours, the drive voltage of the piezoelectric element was gradually increased while applying constant electrostatic voltage (1.5 kV), and voltage (hereinafter referred to as "limit drive voltage") to initiate ejection of liquid droplets from each nozzle was determined. Of the 16 nozzles formed in each nozzle plate, based on the difference between the limit drive voltage of the nozzle which initiated ejection ink droplets and the limit drive voltage of the nozzle which lastly ejected ink droplets, the fluctuation of ejection performance was evaluated. Table 1 shows the obtained evaluation results. The formula to calculate the fluctuation of the ejection performance follows.

Fluctuation of ejection performance (%)=(maximum limit drive voltage−minimum limit drive voltage)/(average of minimum drive voltages of 16 nozzles)×100

TABLE 1

| Experiment No. | Nozzle Diameter (ϕ μm) | Small Diameter portion length (μm) | Water Repellent Film | Fluctuation of Piezoelectric Element Drive Voltage (%) | Evaluation of Liquid Droplet Diameter |
|---|---|---|---|---|---|
| 1 | 1 | 20 | Embodiment 1 | 4 | A |
| 2 | 1 | 10 | Embodiment 1 | 7 | A |
| 3 | 1 | 5 | Embodiment 1 | 9 | A |
| 4 | 3 | 20 | Embodiment 1 | 5 | A |
| 5 | 3 | 10 | Embodiment 1 | 7 | A |
| 6 | 3 | 5 | Embodiment 1 | 8 | A |
| 7 | 5 | 20 | Embodiment 1 | 4 | A |
| 8 | 5 | 10 | Embodiment 1 | 7 | A |
| 9 | 5 | 5 | Embodiment 1 | 9 | A |
| 10 | 8 | 20 | Embodiment 1 | 5 | A |
| 11 | 8 | 10 | Embodiment 1 | 6 | A |
| 12 | 8 | 5 | Embodiment 1 | 7 | A |
| 13 | 10 | 20 | Embodiment 1 | 8 | A |
| 14 | 10 | 10 | Embodiment 1 | 8 | A |
| 15 | 10 | 5 | Embodiment 1 | 10 | A |
| 16 | 1 | 20 | Embodiment 2 | 39 | B |
| 17 | 1 | 10 | Embodiment 2 | 44 | B |
| 18 | 1 | 5 | Embodiment 2 | 49 | B |
| 19 | 3 | 20 | Embodiment 2 | 41 | B |
| 20 | 3 | 10 | Embodiment 2 | 45 | B |
| 21 | 3 | 5 | Embodiment 2 | 52 | B |
| 22 | 5 | 20 | Embodiment 2 | 37 | B |
| 23 | 5 | 10 | Embodiment 2 | 44 | B |
| 24 | 5 | 5 | Embodiment 2 | 51 | B |
| 25 | 8 | 20 | Embodiment 2 | 31 | B |
| 26 | 8 | 10 | Embodiment 2 | 34 | B |
| 27 | 8 | 5 | Embodiment 2 | 37 | B |
| 28 | 10 | 20 | Embodiment 2 | 33 | B |
| 29 | 10 | 10 | Embodiment 2 | 36 | B |
| 30 | 10 | 5 | Embodiment 2 | 39 | B |

In addition, evaluated was the fluctuation of the diameter of liquid droplets ejected from each nozzle followed by deposition. The evaluation criteria follow.

A: fluctuation of the liquid droplet diameter was small

B: some fluctuation of the liquid droplet diameter was noted, but resulted in no problem for commercial viability C: fluctuation of the liquid droplet diameter was significant and resulted in problems for commercial viability As is seen in Table 1, by employing the nozzle plate on which the liquid repellent film was formed according to Embodiment 1, the initial desired ejection state was maintained after drive over a specified period, whereby it is possible to realize the embodiment of a more preferred liquid ejection apparatus.

The invention claimed is:

1. A manufacturing method of a nozzle plate for a liquid ejection head, the nozzle plate comprising a plate having a through hole which comprises a large diameter portion open into one side of the nozzle plate and a small diameter portion which has a smaller cross section than a cross section of the large diameter portion, the small diameter portion open into an other side surface of the nozzle plate, and in which an aperture of the small diameter portion of the through hole is employed as a liquid droplet ejection hole, the manufacturing method comprising:

preparing a substrate comprising a first base member composed of Si having an Si anisotropic dry etching rate and a second base member provided directly on a surface of one side of the first base member with an anisotropic dry etching rate and wherein the anisotropic dry etching rate in the second base member is lower than the Si anisotropic dry etching rate in the first base member;

forming a film on a surface of the second base member which is to be converted to a second etching mask;

forming a second etching mask pattern having an aperture shape of the small diameter portion by applying a photolithography treatment and etching to the film which is to be converted to the second etching mask;

carrying out the etching until an etching part is extended through the second base member;

forming a film which is to be converted to a first etching mask on a surface of the first base member;

forming a first etching mask pattern having an aperture shape of the large diameter portion by applying a photolithography treatment and etching to the film which is to be converted to the first etching mask; and carrying out Si anisotropic dry etching until the first base member is passed through.

2. The manufacturing method of the nozzle plate for the liquid ejecting head described in claim 1, wherein the manufacturing method is carried out in the following order:

preparing the substrate;

forming the film on the surface of the second base member;

forming the second etching mask pattern;

carrying out the etching until the second base member is passed through;

forming the film which is to be converted to the first etching mask;

forming the first etching mask pattern; and carrying out the Si anisotropic dry etching.

3. The manufacturing method of the nozzle plate for the liquid ejecting head described in claim 2, wherein the second base member is composed of $SiO_2$.

4. The manufacturing method of the nozzle plate for the liquid ejecting head described in claim 2, further comprising forming a liquid repellent layer on a surface of a side of the nozzle plate where the liquid ejection opening is formed.

5. The manufacturing method of the nozzle plate for the liquid ejecting head described in claim 1, wherein the manufacturing method is carried out in the following order:

preparing the substrate;

forming the film which is to be converted to the first etching mask;

forming the first etching mask pattern;

carrying out the Si anisotropic dry etching;

forming the film on the surface of the second base member;

forming the second etching mask pattern; and etching the second base member.

6. The manufacturing method of the nozzle plate for the liquid ejecting head described in claim 5, wherein the second base member is composed of $SiO_2$.

7. The manufacturing method of the nozzle plate for the liquid ejecting head described in claim 5, further comprising forming a liquid repellent layer on a surface of a side of the nozzle plate where the liquid ejection opening is formed.

* * * * *